United States Patent [19]

Fujita et al.

[11] 4,139,973

[45] Feb. 20, 1979

[54] ASSEMBLY OF A GLASS SHEET AND A SASH

[75] Inventors: Ryuzo Fujita, Amagasaki; Hirokazu Sugiyama, Itami, both of Japan

[73] Assignee: Nippon Sheet Glass Co., Inc., Osaka, Japan

[21] Appl. No.: 776,852

[22] Filed: Mar. 11, 1977

[30] Foreign Application Priority Data

| | | | |
|---|---|---|---|
| Mar. 18, 1976 | [JP] | Japan | 51/30681 |
| Mar. 22, 1976 | [JP] | Japan | 51/31680 |
| Apr. 1, 1976 | [JP] | Japan | 51/40574 |

[51] Int. Cl.[2] ..... E04B 1/62; E04F 15/14

[52] U.S. Cl. ..... 52/397; 52/309.3; 52/744; 52/823

[58] Field of Search ..... 52/475, 746, 744, 616, 52/627, 171, 628, 397, 309.3, 399, 309.5, 400

[56] References Cited

U.S. PATENT DOCUMENTS

| | | | |
|---|---|---|---|
| 1,872,309 | 8/1932 | Loebel | 52/400 |
| 2,901,785 | 9/1959 | Hinchliffe et al. | 52/397 X |
| 3,023,859 | 3/1962 | Muessel | 52/397 X |
| 3,081,849 | 3/1963 | Hubbard | 52/397 X |
| 3,093,217 | 6/1963 | Doede | 52/397 X |
| 3,442,059 | 5/1969 | Kessler | 52/399 |
| 3,807,107 | 4/1974 | Davis | 52/397 X |
| 3,881,290 | 5/1975 | Bouchey | 52/397 X |
| 3,934,384 | 1/1976 | Davis | 52/397 |

FOREIGN PATENT DOCUMENTS

| | | | |
|---|---|---|---|
| 2400320 | 7/1975 | Fed. Rep. of Germany | 52/616 |
| 2500989 | 7/1975 | Fed. Rep. of Germany | 52/475 |
| 641906 | 12/1959 | Italy | 52/397 |

*Primary Examiner*—Leslie Braun

*Attorney, Agent, or Firm*—Wenderoth, Lind & Ponack

[57] ABSTRACT

A method for fixing a glass sheet in a sash which is to surround the entire peripheral edge of the glass sheet and has a channel defined by a bottom wall and side walls; and the resulting assembly of the sash and the glass sheet fixed therein. The glass sheet is set in the sash, and then fixed elastically in the channel at positions spaced at intervals along the peripheral edge of the glass sheet. Then, an elastic sealing material is filled along the entire peripheral edge of the glass sheet between each of the surfaces of the peripheral edge of the glass sheet and each of the side walls of the channel opposite thereto, leaving an unfilled space at the bottom of the channel. Subsequent hardening of the sealing material affords a substantially fluid-tight seal along the entire peripheral edge of the glass sheet between each of the surfaces of the peripheral edge of the glass sheet and each of the side walls of the channel opposite thereto, and achieves the fixation of the glass sheet in the sash.

17 Claims, 25 Drawing Figures

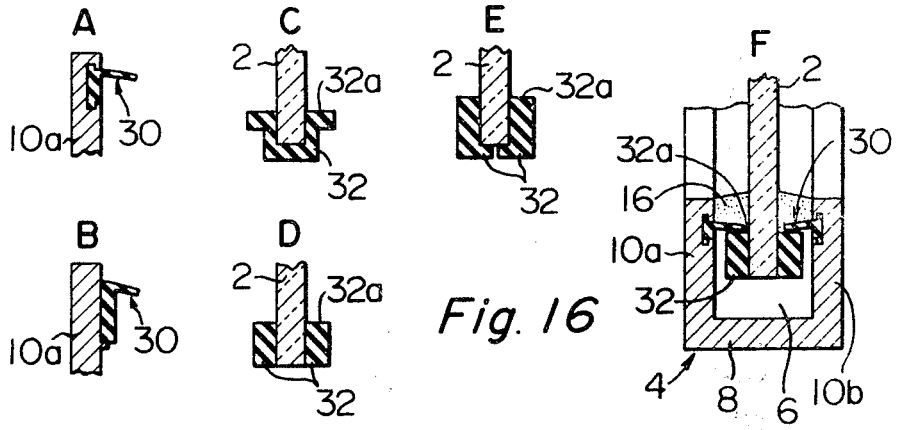
Fig. 16
Fig. 17
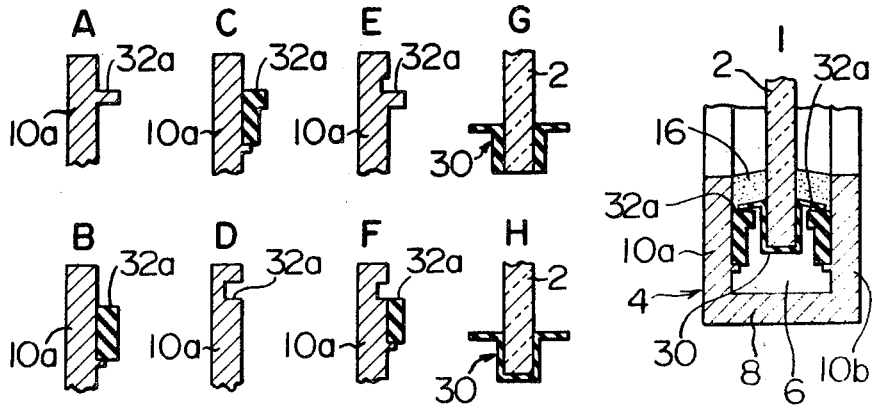
Fig. 18
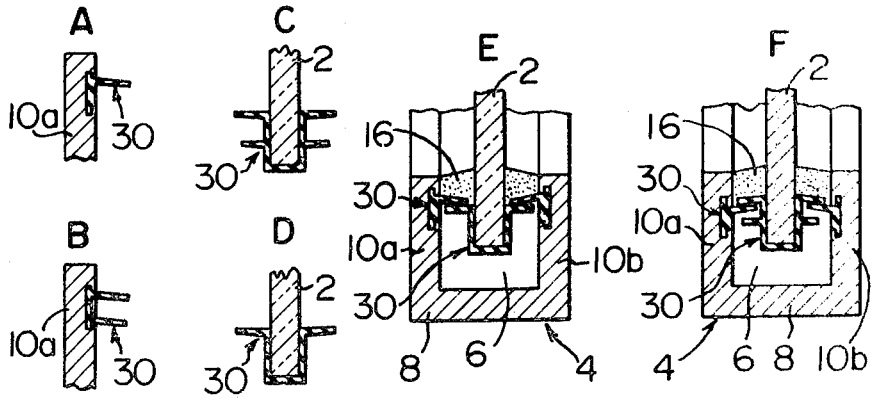

ASSEMBLY OF A GLASS SHEET AND A SASH

FIELD OF THE INVENTION

This invention relates to an assembly of a glass sheet and a sash.

DESCRIPTION OF THE PRIOR ART

In recent years, there has been an increasing number of tall buildings using many large-sized glass sheets (with each side measuring more than about 1.5 meters) which are fixed in sashes as an exterior wall. Such glass sheets reflect views of the areas around the buildings, and provide aesthetic beauty. However, these glass sheets have the defect of causing greater distortion of images reflected thereby The higher their ability to reflect and the larger they are in size. Particularly, thermic ray-reflecting glass sheets, because of their very good reflecting performance, tend to give markedly distorted images as compared with thermic ray-absorbing glass sheets or transparent glass sheets.

Distortion of reflected images is ascribable mainly to various deformations which occur in the glass sheets when fixing them in sashes, especially (i) local deformations which occur when forcibly fitting a spacer between the glass sheet and the sash, and (ii) deformations which occur owing to the distortion of the sash caused by a fixing error in securing the sashes to a building, and to manufacturing imperfections (such as warping or torsion) of the sashes and spacer.

Generally, a glass sheet, especially a large-sized one, is set in a sash surrounding its entire peripheral edge and having a channel defind by a bottom wall and side walls for positioning the peripheral edge of glass sheet therein. In order to prevent the concentration of thermal stress on the peripheral edge of glass sheet which is due to heat transmission from the sash, and to avoid direct transmission to the glass sheet of stresses caused by, for example, the distortion of the sash, fixation of glass sheets in sashes has previously been performed in the manner described below.

First, the entire peripheral edge of a glass sheet is positioned in the channel spaced from the bottom wall and side walls of the channel by placing setting blocks on the bottom wall of the channel at the lower side of the sash; or by suspending the glass sheet from the bottom wall of the channel at the upper side of the sash and/or from the side walls using a suitable suspending means. Then, a spacer made of an elastic material having a relatively high hardness, such as synthetic rubber, and extending continuously along the entire peripheral edge of the glass sheet is inserted forcibly betwen each of the two surfaces of the peripheral edge of the glass sheet and each of the side walls of the channel opposite thereto, thus elastically fixing the entire peripheral edge of the glass sheet in the channel. Then, an elastic sealing material in the softened state is filled over the spacer and between each of the surfaces of the peripheral edge of the glass sheet and the side walls of the channel opposite thereto along the entire peripheral edge of the glass sheet. The filled elastic sealing material is then hardened to form a substantially fluid-tight seal between the surface of the peripheral edge of the glass sheet and the two side walls of the channel opposite thereto.

Thus, according to this conventional method, a continuously extending elastic spacer is forcibly inserted along the entire peripheral edge of the glass sheet between the surfaces of the peripheral edge of the glass sheet and the side walls of the channel opposite thereto. If the two side walls of the sash are not straight because of warping or torsion for example, the glass sheet deforms according to the shape of the two side walls. Consequently, the flatness of the glass sheet is impaired, and images reflected thereby are distorted.

Even when there is no general deviation in the linearity of the two side walls of the channel, glass sheets are usually not completely flat, but possess a slight warping (which, however, is not sufficient to affect the reflected images adversely) ascribable to the manufacturing process. For this reason, the length of the space between each of the surfaces of the peripheral edge of the glass sheet and each of the two side walls of the channel is not completely uniform along the entire peripheral edge of the glass sheet. Insertion of a continuously extending, rather hard, elastic spacer having a uniform thickness in this space results in forcible deformation of the peripheral edge of the glass sheet in opposition to its natural warping, and may cause local distortion of images reflected thereby.

On the other hand, when the elasticity of the spacer is reduced too much in an attempt to equalize its load on the glass sheet, the ability of the spacer to hold the glass sheet is reduced, and before a sealing material is filled and hardened over it, even a slight external force such as wind pressure or vibration will result in considerable displacement of the glass sheet within the sash.

SUMMARY OF THE INVENTION

It is an object of this invention to provide an asssembly of a glass sheet and a sash, in which the glass sheet is fixed in the sash with reduced distortions, thus offering a solution to the problem of distortion of images reflected from the glass sheet.

According to the present invention, there is provided an assembly of a glass sheet and a sash surrounding the entire peripheral edge of the glass sheet and having a channel defined by a bottom wall and side walls with the glass sheet fixed in the sash wherein (a) the entire peripheral edge of the glass sheet is positioned in the channel spaced from the bottom wall and side walls of the channel, (b) elastic spacers are inserted in the space between the surfaces of the peripheral edge of the glass sheet the side walls of the channel opposite thereto at positions spaced at intervals along the peripheral edge of the glass sheet, thereby to fix the glass sheet in the sash at said spaced positions, and (c) a seal is formed along the entire peripheral edge of the glass sheet by an initially a softened or liquid and subsequently hardened elastic sealing material filling the space between the surfaces of the peripheral edge of the glass sheet and the side walls of the channel opposite thereto while leaving an unfilled space at the bottom of the channel, said seal being substantially fluid-tight and covering the entire peripheral edge of the glass sheet, thus fixing the glass sheet in the sash.

Furthermore, according to the present invention, there is provided an assembly of a glass sheet and a sash surrounding the entire peripheral edge of the glass sheet and having a channel defined by a bottom wall and side walls with the glass sheet fixed in the sash wherein (a) the entire peripheral edge of the glass sheet is positioned in the channel spaced from the bottom wall and side walls of the channel, (b) back-up members having an elastic tongue-like part are fixed to one of (i) each surface of the peripheral edge of the glass sheet and (ii) each side wall of the channel, and supporting surfaces for supporting the forward end of each tongue-like part are provided in the other of (i) or (ii), said elastic tongue-like part being adapted to extend from one of (i) and (ii) to the other with the forward end thereof approaching the other, and said supporting surfaces being positioned nearer to the bottom wall than said tongue-like parts, and (c) a seal is formed along the entire peripheral edge of the glass sheet by an initially softened or liquid and subsequently hardened elastic sealing material over the tongue-like parts of the back-up members and filling the space between each of the surfaces of the peripheral edge of the glass sheet and each of the side walls of the channel opposite thereto with an unfilled space left at the bottom of the channel, thereby sealing a substantially fluid-tight the space between each of the surfaces of the peripheral edge of the glass sheet and each of the side walls of the channel along the entire peripheral edge of the glass sheet, and fixing the glass sheet in the sash.

The above and other objects and advantages of the invention will become apparent from the following description taken in conjunction with the accompanying drawings.

BRIEF DESCRIPTION OF THE DRAWINGS

FIG. 12 being a sectional view taken along the line XII—XII of FIG. 13, and FIG. 13 being a sectional view taken along the line XIII—XIII of FIG. 12;

FIG. 16-A through 16-F are partial, sectional views showing modified embodiments of a back-up member to be fitted to the side walls of a sash channel, modified embodiments of a member to be fitted to the peripheral edge of a glass sheet to form a supporting surface for the forward end of a tongue-like part of a back-up member, and combinations of the two;

FIGS. 17-A through 17-I are partial, sectional views showing modified embodiments of a supporting surface secured to the side walls of a sash channel to support the forward end of a tongue-like part of a back-up member, modified embodiments of a back-up member fitted to the peripheral edge of a glass sheet, and combinations of the two;

FIGS. 18-A through 18-F are partial, sectional views of modified embodiments of a back-up member secured to the side walls of a sash channel or of a member for forming a support surface for the forward end of a tongue-like part of a back-up member, modified embodiments of a back-up member secured to the peripheral edge of a glass sheet or of a member for forming a supporting surface for a tongue-like part of a back-up member, and combinations of the two;

Throughout the entire drawings, the same reference numerals designate the same elements.

DETAILED DESCRIPTION OF PREFERRED EMBODIMENTS

Figure 1:
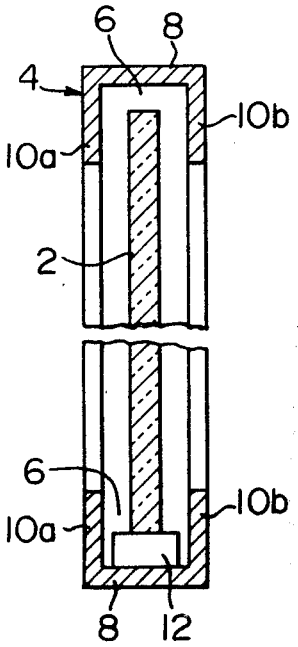
FIGS. 1 and 2 show a glass sheet set in a sash, FIG. 1 being a sectional view taken along the line I—I of FIG. 2, and FIG. 2 being a front elevation partly broken away.
Figure 2:
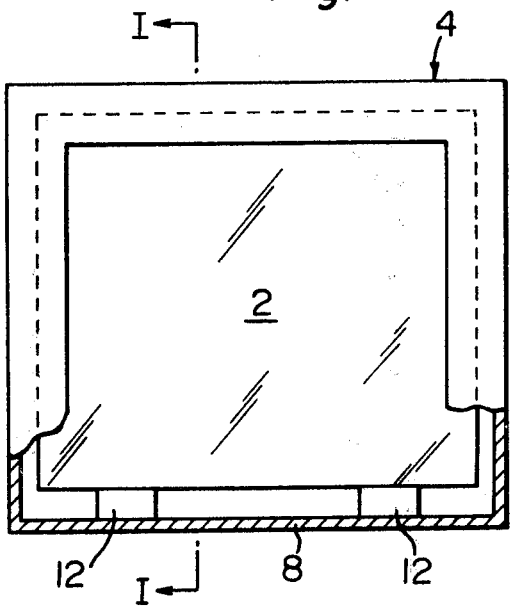
Figure 3:
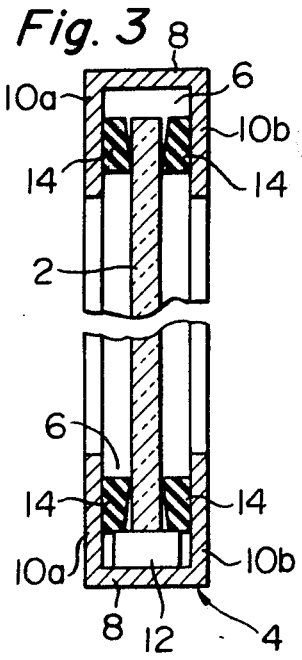
FIG. 3 is a sectional view showing elastic spacers inserted in the structure of FIG. 1.
Figure 6:
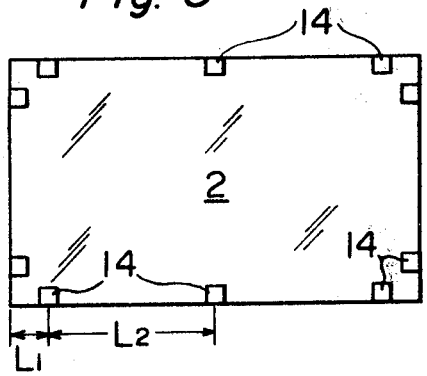
FIG. 6 is a simplified view illustrating positions at which elastic spacers are inserted.

Referring to FIGS. 1 and 2, a rectangular glass sheet 2 and a sash 4 in which the glass sheet 2 is set are shown. The sash 4 surrounds the entire peripheral edge of the glass sheet 2 and has a bottom wall 8 and side walls 10*a* and 10*b* which define a channel 6 in which the peripheral edge of the glass sheet 2 is positioned.

According to the present invention, the glass sheet 2 is fixed in the sash 4 in the manner described below. First, the entire peripheral edge of the glass sheet 2 is positioned in the channel 6 spaced from the bottom wall 8 and side walls 10*a* and 10*b*, and thus, the glass sheet 2 is set in the sash 4. This can be accomplished by known methods. For example, as shown in FIGS. 1 and 2, setting blocks 12 of a predetermined thickness made of an elastic material such as neoprene rubber (usually, two such blocks are used) are placed on the bottom wall 8 of the channel at the lower side of the sash 4. Then, the bottom edge of the sheet 2 is placed on the setting blocks, and the glass sheet 2 is positioned approximately at the center of the channel 6 with respect to the width of the channel. As a result, the peripheral edge of the glass sheet 2 is positioned in the channel 6 spaced from the bottom wall 8 and side walls 10*a* and 10*b*.

Alternatively, the glass sheet 2 can be set in the sash 4 in the aforesaid state by suspending the glass sheet 2 from the bottom wall 8 at the upper side of the sash 4 and/or from the side wall 10*a* or 10*b* using a known suspending means (not shown).

Figure 4:
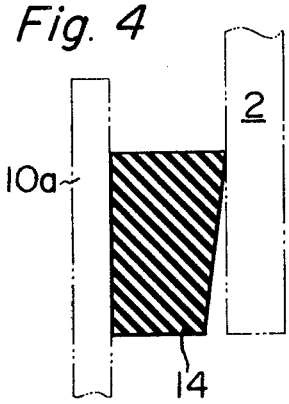
FIGS. 4 and 5 are sectional views of prefabricated elastic spacers.
Figure 5:
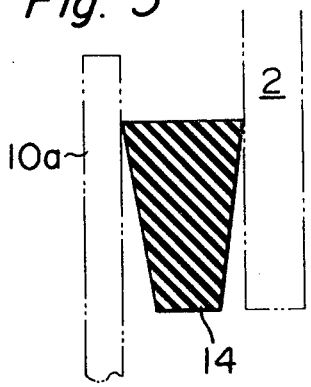

Then, elastic spacers are inserted in the space between each of the surfaces of the peripheral edge of glass sheet 2 and each of the side walls 10*a* and 10*b* of channel 6 opposite thereto at positions spaced at intervals along the peripheral edge of glass sheet 2. As a result, the peripheral edge of glass sheet 2 is elastically held or fixed to the channel 6 of sash 4 at positions spaced at intervals along the peripheral edge of the glass sheet 2. Insertion of the elastic spacers can be accomplished by stuffing elastic spacers 14 which have been pre-fabricated into the desired shape into the space between each of the surfaces of the peripheral edge of glass sheet 2 and each of the side walls 10*a* and 10*b* of channel 6 opposite thereto at predetermined positions. Alternatively, instead of using the pre-fabricated elastic spacers 14, the insertion of the elastic spacers can be accomplished by filling a suitable amount of a softened or liquid elastic material such as room temperature curable polyurethane sealant, a silicne sealant, or a fast-curing polysulfide-type sealant (such as sold under the trademark THIOKOL) in the space between each of the surfaces of the peripheral edge of glass sheet 2 and each of the side walls 10*a* and 10*b* of channel 6 opposite thereto at predetermined positions, and then hardening the elastic material. Both of these methods may be used in combination to insert the elastic spacers.

Where pre-fabricated elastic spacers 14 are to be used, it is preferred to prepare them in various thicknesses, and to select the most suitable ones according to the width of the space into which they are to be inserted. Or the selection may be made while observing images reflected from the glass sheet 2. The elastic spacers 14 may be of any desired shape, for example, rectangular in cross section. However, an elastic spacer tapered at that surface which is to come into contact with the surface of glass sheet 2 as shown in FIG. 4, or an elastic spacer tapered both at that surface which will come into contact with the surface of glass sheet 2 and at that surface which will come into contact with the side wall 10*a* or 10*b* of channel 6 as shown in FIG. 5 is preferred. These tapered spacers have the advantage that the initial force pressing on the glass sheet 2 is comparatively small, and when the elastic spacers 14 deform upon the application of an external force to glass sheet 2, they have a larger area of contact with the glass sheet 2 so as to provide an increased force to hold or fix the glass sheet 2.

The elastic spacers 14 may be of any material having rubbery elasticity. For example, natural rubbers, synthetic rubbers such as neoprene rubber and various soft synthetic resins, above all neoprene rubber having a Shore hardness of about 60, can be conveniently used.

The following care must be taken in the insertion of elastic spacers. As set forth at the beginning of the present specification, according to the conventional techniques, a pre-fabricated elastic spacer extending continuously along the entire peripheral edge of glass sheet is inserted between each of the surfaces of the peripheral edge of the glass sheet and each of the side walls of the channel opposite thereto. Hence, this brings about the defect that deformations occur owing to the non-linearity of the side walls of the channel, and consequently, images reflected from the glass sheet are distorted. In contrast, according to the present invention, the elastic spacers are inserted at positions spaced at intervals along the peripheral edge of the glass sheet. Hence, even when the width of the space between the surface of the glass sheet and the side wall of the each channel differs greatly from place to place owing, for example, to the presence of extreme bending or warping of the sash, especially on both of its side walls, the thickness of the spacer can be adjusted at each inserting position by properly selecting a pre-fabricated spacer having a thickness conforming to the width, or by filling and hardening a softened or liquid elastic material which will cure to a thickness conforming to the width of the space. Accordingly, the glass sheet can be fixed elastically to the sash without causing enforced deformations of the glass sheet which oppose the inherent shape of the glass sheet and become a cause of distortion of the reflected images. Furthermore, since the contact area of the spacer with the glass sheet is less as compared with the conventional techniques, the extent of unavoidable local deformations which center around those parts of the glass which are pressed by the spacer is markedly reduced as compared with the conventional techniques, and the quality of the reflected images is improved.

The intervals between the positions of the elastic spacers are of importance. If these intervals are too small, the number of spacers inserted increases, and there is more likelihood of local deformation of the glass sheet 2. Moreover, the inserting work is time-consuming. On the other hand, if the intervals are too large, the glass sheet 2 will not be held or fixed sufficiently tightly for the operation of filling the fluid-tight sealing material into one channel or until the filled sealing material is cured, the sheet is likely to move accidentally. In view of these problems, it is preferred that at least one elastic spacer be inserted adjacent each corner of glass sheet in a position in which the distance ($L_1$) from the center of the elastic spacer to the corner of the glass sheet is the product of the length of one side of glass sheet 2 multiplied by $\frac{1}{8}$, and elastic spacers be inserted at intervals with the distance ($L_2$) between two adjacent spacers being about 400 mm to 900 mm depending on the length of the side of the glass sheet 2.

The length of each elastic spacer in the direction along the peripheral edge of glass sheet 2 is suitably 20 to 30 mm.

After fixing the glass sheet 2 in the channel by the insertion of the elastic spacers in the manner described above, images reflected from the entire glass sheet 2 should preferably be examined visually. Then, as needed, the elastic spacers 14 can be replaced; or the position of glass sheet 2 can be partly corrected, and a softened or liquid elastic material is again filled into the channel and hardened to form elastic spacers in situ.

Figure 7:
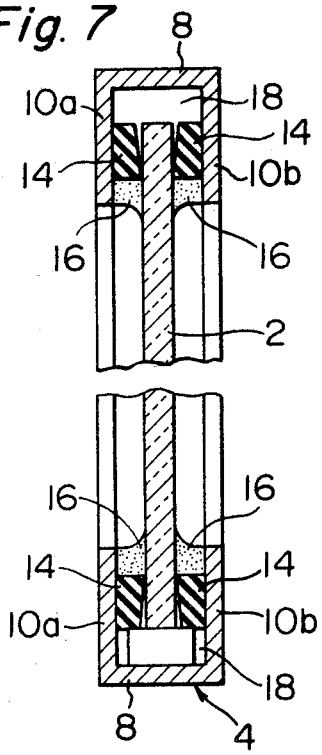
FIG. 7 is a sectional view showing the sash of FIG. 3 with an elastic sealing material therein.

Then, as illustrated in FIG. 7, a softened or liquid elastic sealing material such as a silicone sealant is filled into a space between each of the surfaces of the peripheral edge of glass sheet 2 and each of the side walls 10*a* and 10*b* of channel 6 opposite thereto along the entire peripheral edge of the glass sheet 2, and then hardened in a known manner. As a result, a substantially fluid-tight seal 16 is formed along the entire peripheral edge of glass sheet 2 in the space between each of the surfaces of the peripheral edge of glass sheet 2 and each of the side walls 10*a* and 10*b* of channel 6 opposite thereto, and the glass sheet 2 is fixed in an exact position in sash 4. At this time it is important that channel 6 of sash 4 should not be substantially completely filled with the elastic sealing material, but an unfilled space 18 having a predetermined volume should be left at the bottom of channel 6. Water, for example, which gathers in channel 6 after passing through minute spaces that may occur between glass sheet 2 and seal 16 as a result of the long-term use of the finished assembly of the glass sheet 2 and sash 4 can be discharged from the channel through a drainage hole (not shown) provided at the bottom of the channel 6 by utilizing the unfilled space 18. Furthermore, in the event that the glass sheet 2 is subjected to an external force such as wind pressure when it is in the assembly of the glass sheet 2 and the sash 4, this unfilled space permits an increase in the amount of elastic displacement of the peripheral edge of glass sheet 2, and therefore, reduces the stress which may occur in the glass sheet 2. This offers the additional advantage that the amount of relatively expensive fluid-tight sealing material for can be saved.

According to the conventional techniques, an elastic spacer extending continuously along the entire peripheral edge of a glass sheet is inserted between each of the surfaces of the peripheral edge of the glass sheet and each of the side walls of a sash channel opposite thereto. Hence, the inside surface of the elastic spacer, i.e. the surface facing the central part of the glass sheet, functions as a back-up surface for an elastic sealing material, and blocks the flow of the elastic sealing material to the bottom of the channel, thus leaving an unfilled space at the bottom of the channel. In contrast, since according to the present invention, the elastic spacers are inserted at positions spaced at intervals along the peripheral edge of the glass sheet 2, no back-up surface exists between the elastic spacers, and the elastic sealing material being filled into the channel is likely to flow to the bottom of channel 6, leaving no unfilled space at the bottom. If an elastic sealing material having great tackiness is used, it is possible to prevent the advancing of the sealing material to the bottom of the channel by the friction of the elastic sealing material with the surfaces of the peripheral edge of glass sheet 2 and the side walls 10*a* and 10*b* of channel 6. But the highly tacky sealing material is comparatively difficult to use, and moreover, the volume of the unfilled space cannot be adjusted to the desired value.

It is desired therefore to provide a back-up means which will back up the elastic sealing material filled into the space between the glass and the channel and leave an unfilled space having a predetermined volume at the bottom of channel 6.

The back-up means may be a back-up member 20 for example, as shown in FIGS. 8 to 11, which is located between elastic spacers 14 in the space between each of the surfaces of the peripheral edge of glass sheet 2 and each of the side walls 10*a* and 10*b* of channel 6, thereby to form a back-up surface between the elastic spacers 14. It is important that the back-up member 20 have very high flexibility, and therefore exert only a very small load on glass sheet 2.

Figure 8:
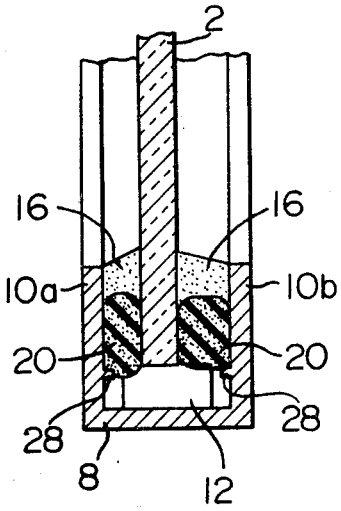
FIGS. 8 to 11 are partial, sectional views showing various back-up members which are positioned among the elastic spacers to form back-up surfaces for the elastic sealing material.
Figure 9:
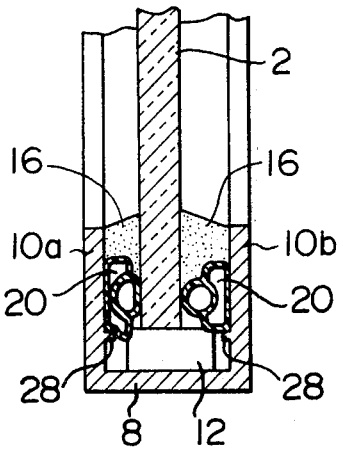
Figure 10:
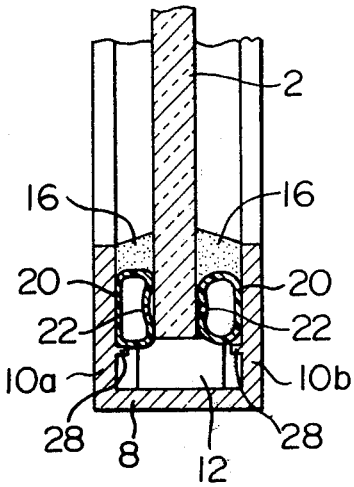
Figure 11:
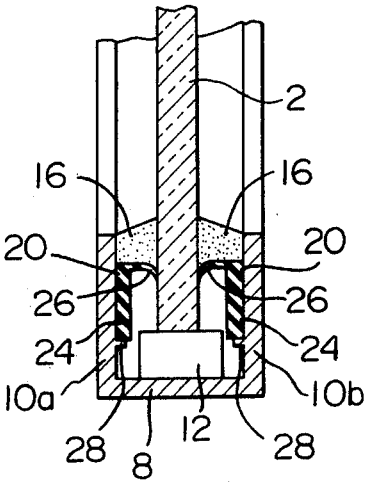

The back-up member 20 illustrated in FIG. 8 is formed of a sponge-like foamed resin. The back-up member 20 illustrated in FIG. 9 is a hollow body of soft plastic which has a thickness of about 0.5 to 0.7 mm. The back-up member 20 illustrated in FIG. 10 is a hollow body of soft plastic which in order to utilize its flexibility, has an air exhaust hole 22 at that surface which is to contact the glass sheet 2. The back-up member 20 shown in FIG. 11 is made of a suitable elastic material having a base portion 24 with a relatively large thickness and a tongue-like portion 26 with a considerably smaller thickness (for example, less than 1 mm) which extends substantially at right angles to the base portion and the forward end of which contacts the surface of the peripheral edge of the glass sheet.

The various back-up members 20 illustrated in FIGS. 8 to 11 may be inserted between adjacent elastic spacers after the insertion of the elastic spacers and before the filling of the elastic sealing material. Or they may be fixed by suitable means, for example, by using an adhesive, at predetermined positions to each of the side walls 10*a* and 10*b* of channel 6 before setting the glass sheet in sash 4. On each of the side walls 10*a* and 10*b* of channel 6, a projection 28 may be formed which fixes the position of the back-up member 20 with respect to the bottom wall 8 of channel 6 and supports the outside surface (the surface which faces the bottom wall 8 of channel 6) of the back-up member 20.

The glass sheet 2 fixed in sash 4 by the method of the invention described hereinabove with reference to FIGS. 1 to 11 undergoes much smaller deformation at the time of fixing than glass sheets fixed in sashes by the conventional methods, and therefore, the distortion of images reflected thereby can be considerably reduced.

As can be readily seen from FIGS. 8 to 11, even in accordance with the method described hereinabove, the back-up member 20 makes contact with the surface of the glass sheet over a considerable portion of the peripheral edge of glass sheet 2, and exerts a pressing force, even though of a slight degree, on the glass sheet. This pressing force is somewhat increased by the filling pressure at the time of filling the elastic sealing material and by the weight of the elastic sealing material after filling. Accordingly, there is still some deformation, although of a considerably smaller degree than in the conventional methods, of the glass sheet 2, and therefore, some distortion of images reflected by the glass sheet 2.

In a modified embodiment in accordance with this invention which is described below with reference to FIGS. 12 to 15, the above drawback can be avoided so that the deformation of the glass sheet 2 at the time of fixing it to sash 4 is further reduced, and the distortion of images reflected from the glass sheet 2 is further reduced. In this embodiment, another type of back-up member is fixed to one of (i) each of the surfaces of the peripheral edge of glass sheet 2 and (ii) each of the side walls 10*a* and 10*b* of channel 6 in sash 4 before glass sheet 2 is set in sash 4 as illustrated in FIG. 1. This type of back-up member has an elastic tongue-like part which extends from one of (i) and (ii) toward the other and the free end of which approaches the other of (i) or (ii) without contacting it. On the other of (i) and (ii), a supporting surface which is located nearer the bottom wall 8 of channel 6 than the tongue-like part is provided so as to support the free end of the tongue-like part.

Figure 12:
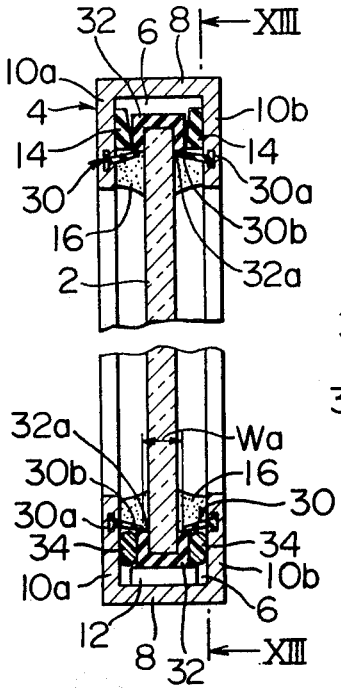
FIGS. 12 and 13 show an assembly of a glass sheet and a sash in which the glass sheet is fixed in the sash in accordance with a modified embodiment of the present invention.

Referring to FIG. 12 which shows glass sheet 2 already fixed in sash 4, an elastic back-up member 30 to be described hereinbelow is fitted on each of the side walls 10*a* and 10*b* of channel 6 of sash 4 before the glass sheet 2 is set in sash 4 (FIG. 1). Also before the setting of glass sheet 2 in sash 4, a member 32 for forming a supporting surface, to be described in detail hereinbelow, is fitted on the peripheral edge of glass sheet 2.

A slot which is substantially T-shaped in cross section is formed in each of the side walls 10*a* and 10*b* of channel 6 of sash 4 around its entire periphery, and the back-up member 30 is fitted into this slot. The back-up member 30 consists of a base portion 30*a* to be fitted into the slot and a tongue-like portion 30*b* which extends from the base portion 30*a* toward the surface of the glass sheet 2 substantially at right angles to the side walls 10*a* and 10*b*. The distance (W*a*) between the free ends of the tongue-like portions 30b of a pair of the back-up members 30 secured to the side walls 10a and 10b of channel 6 is somewhat larger than the thickness of glass sheet 2 the peripheral edge of which is to be passed through the space between the free ends of the tongue-like portions for setting in channel 6. On the other hand, an edge-covering member 32 having a substantially U-shaped cross section is fitted around the entire periphery of glass sheet 2. The member 32 is made of an elastic material such as synthetic rubber, and has a width smaller than the gap between the side walls 10a and 10b of channel 6 but larger than the above-described distance W*a*. When glass sheet 2 is set in sash 4, the end surfaces 23a of the V-shaped 32 are positioned nearer to the bottom wall 8 of channel 6 than the tongue-like portion 30b of the back-up member 30, and the end surfaces 32a of the member 32 form supporting surfaces for the tongue-like portions 30b of the back-up members 30.

The assembly of a glass sheet 2 and a sash 4 illustrated in FIG. 12 can be obtained by fixing glass sheet 2 in sash 4 in the manner described below.

First, a glass sheet 2 having the member 32 fitted around its entire periphery is positioned in channel 6 spaced from the bottom wall 8 and the side walls 10a and 10b defining channel 6, and is thus set in sash 4. As already described in relation to FIGS. 1 and 2, the setting of glass sheet 2 in sash 4 can be accomplished by using setting blocks 12 or suspending means (not shown). The width of the member 32 fitted around the entire periphery of glass sheet 2 is larger than the distance W*a* betwen the free ends of the tongue-like portions 30b. But since the tongue-like portions 30b have sufficient elasticity, the peripheral edge of glass sheet 2 having the member 32 fitted thereover can be passed between the free ends of the tongue-like portions 30b, and set at a position between these free ends and the bottom of channel 6.

Then, the peripheral edge of glass sheet 2 is held or fixed elastically in channel 6 of sash 4 at positions spaced at intervals along the peripheral edge of glass sheet 2. This can be accomplished, as already described hereinabove with reference to FIG. 3, by stuffing elastic spacers 14 pre-fabricated into the desired shape between each of the surfaces of the peripheral edge of glass sheet 2 and each of the side walls 10a and 10b of channel 6 opposite thereto at positions spaced at intervals along the peripheral edge of glass sheet 2; or by filling a suitable amount of a softened or liquid elastic material in the above space and hardening it; or by performing these two procedures in combination.

Figure 13:
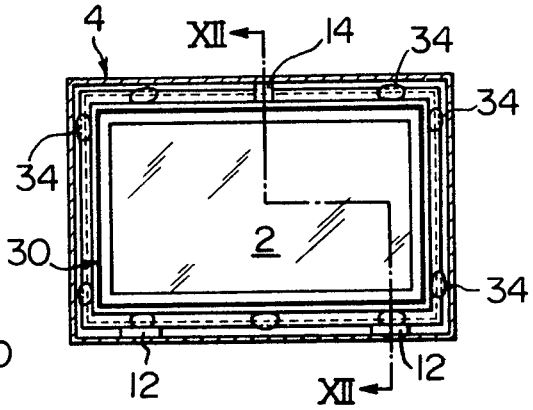

In the modified embodiment illustrated in FIGS. 12 and 13, a pre-fabricated elastic spacer 14 is stuffed along one position at the upper side of glass sheet 2 between each of the side surfaces of the member 32 fitted over the peripheral edge of glass sheet 2 and each of the side walls 10a and 10b of channel 6 opposite thereto. Then, a softened or liquid elastic material 34 is filled, and hardened, between each of the side surfaces of the member 32 fitted over the peripheral edge of glass sheet 2 and each of the side walls 10a and 10b of channel 6 opposite thereto at positions spaced at intervals along the remainder of the peripheral edge of glass sheet 2.

According to an alternative procedure, an elastic material, which may be the same as the elastic sealing material to be filled over tongue-like member 30b along the entire peripheral edge of glass sheet 2 and hardened, is filled over the tongue-like part 30b of back-up member 30, with respect to sash 4, that is, inwardly of tongue-like members 30b between each of the surfaces of the peripheral edge of glass sheet 2 and each of the side walls 10a and 10b of channel 6 at positions spaced at intervals along the entire periphery of glass sheet 2 and hardened, thereby holding or fixing the peripheral edge of glass sheet 2 in channel 6 of sash 4 at the positions spaced at intervals along the peripheral edge of glass sheet 2. In other words, it is possible in the subsequent step of filling the elastic sealing material to fill and rapidly harden an elastic sealing material at positions spaced at intervals along the peripheral edge of glass sheet 2 thereby holding or fixing the peripheral edge of glass sheet 2 in channel 6 of sash 4 at these positions, and then to fill and harden an elastic sealing material so as to form a seal along the entire peripheral edge of glass sheet 2.

In the modified embodiment illustrated in FIGS. 12 and 13, after the peripheral edge of glass sheet 2 has been held or fixed by pre-fabricated elastic spacers 14 and hardened elastic material 34 at positions spaced apart at intervals therealong, a softened or liquid elastic sealing material such as a silicone sealant is filled over the tongue-like portions 30b of the back-up members 30 (i.e., inwardly, with respect to the sash 4, of the tongue-like portions 30b in the space between each of the surfaces of the peripheral edge of glass sheet 2 and each of the side walls 10a and 10b of channel 6 opposite thereto) along the entire peripheral edge of glass sheet 2. As a result, a substantially fluid-tight seal 16 is formed between each of the surfaces of the peripheral edge of glass sheet 2 and each of the side walls 10a and 10b of channel 6 along the entire peripheral edge of glass sheet 2, and the glass sheet 2 is fixed at an exact position in sash 4.

A force for displacing the tongue-like portions 30b toward the bottom wall 8 of channel 6 acts at the time of filling the elastic sealing material and during the time from its filling to hardening. However, since the free ends of the tongue-like portions 30b are supported by the end surfaces 32a of the U-shaped members 32 over the entire peripheral edge of glass sheet 2, the elastic sealing material is substantially uniformly filled, and hardened, along the entire peripheral edge of glass sheet 2, leaving an unfilled space having a predetermined volume the the bottom of channel 6. Hence, this has an effect of equalizing the displacement which may occur in the peripheral edge of glass sheet 2 when an external force such as wind pressure is exerted on it after it has been fixed in sash 4, and the stress generated in glass sheet 2 is dispersed uniformly. Furthermore, since the fall ends of tongue-like portions 30b of back-up members 30 do not make contact with the surfaces of glass sheet 2 but are spaced from them, and no pressing force is exerted from the back-up members 30 on the surface of glass sheet 2, therefore, the glass sheet 2 is free from deformation. The fact that the back-up members 30 do not make contact with the surface of glass sheet 2 also brings about the advantage that a material of a relatively high hardness can be used to produce the back-up members 30, and a softened or liquid fluid-tight sealing material can be filled at relatively high extrusion pressures along the entire peripheral edge of glass sheet 2, thus increasing the effectiveness of the sealing step.

Figure 14:
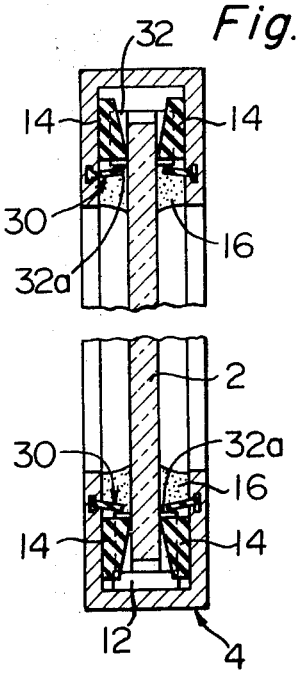
FIG. 14 is a sectional view, similar to FIG. 12 of an assembly of a glass sheet and a sash in which the glass sheet is fixed in the sash in accordance with another modified embodiment of the present invention.
Figure 15:
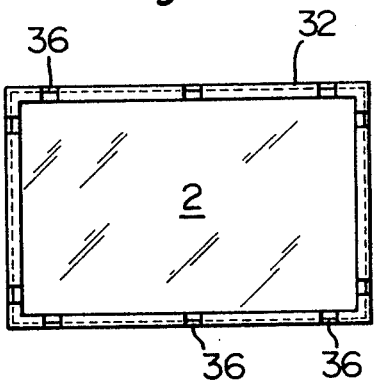
FIG. 15 is a front elevation view of a member which is to form a supporting surface for the forward end of a tongue-like part of a back-up member in FIG. 14.
Figure 19:
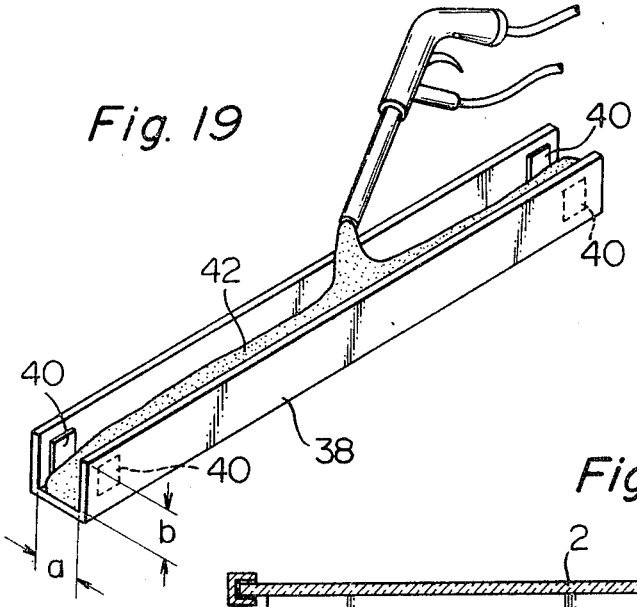
FIG. 19 is a perspective view showing a frame member bonded to the peripheral edge of a glass sheet, and an adhesive being filled in the frame member.

FIGS. 14 and 15 show another embodiment resulting from some modification of the embodiment shown in FIGS. 12 and 13. As shown in FIG. 15, several notches 36 are provided at intervals along the edge-covering member 32 fitted over the peripheral edge of glass sheet 2. Elastic spacers of suitable thickness are stuffed into these recesses 36 at which the surfaces of the peripheral edge of glass sheet 2 are exposed. Thus, the glass sheet is fixed with one surface of each elastic spacer 14 being in direct contact with its peripheral edge.

The back-up member having tongue-like portion 30*a* which is to be secured to each of the side walls 10*a* and 10*b* of channel 6 of sash 4 can take various forms as shown in FIGS. 16-A and 16-B, and the supporting surface for the forward end of the tongue-like portion 30*a* can be made of a material of various shapes as shown in FIGS. 16-C to 16-E.

The back-up member 30 illustrated in FIG. 16-A includes a base portion 30*a* in a two-staged shape which is to be fitted in a slot formed in the side walls of the channel, and a tongue-like portion 30*b* extending from the inward, with respect to the channel, end (the upper end in the drawings) of base portion 30*a* approximately at right angles to the side walls.

The back-up member 30 shown in FIG. 16-B includes a base portion 30*a* to be bonded to the surface of the side wall of channel by an adhesive or by some suitable means and a tongue-like portion 30*b* extending from its inward end (the upper end in the drawings) approximately at right angles to the side wall.

FIG. 16-C shows supporting surface 32*a* formed of the inner surface of the flange portion of member 32 fitted over the entire peripheral edge of glass sheet 2.

FIGS. 16-D and 16-E show supporting surfaces 32*a* formed of the inner surfaces of members 30, made of an elastic material such as synthetic rubber, bonded to each of the surface of the peripheral edge of glass sheet 2.

FIG. 16-F illustrates a combination of the back-up member 30 shown in FIG. 16-A, and the supporting surface 32*a* shown in FIG. 16-D.

Alternnatively, as shown in FIGS. 17-A to 17-I, supporting surface 32*a* formed on each of the side walls 10*a* and 10*b* of the channel in the sash, and back-up member 30 having tongue-like portion 30*b* extending approximately at right angles to the surface of glass sheet 2 is secured to the peripheral edge of glass sheet 2.

FIG. 17-A shows a supporting surface 32*a* constituted by the inner surface of a projection provided on the side wall of the channel.

FIGS. 17-B and 17-C show supporting surfaces 32a formed of the inner surfaces of the elastic members bonded to the side walls 10*a* and 10*b* of the channel.

FIG. 17-D shows supporting surface 32 formed of the bottom surface of a notch provided in the side wall of the channel.

FIG. 17-E shows a supporting surface 32*a* formed of the bottom surface of a notch provided in the side wall of the channel and the inner surface of a projection provided in the side wall of the channel.

FIG. 17-F shows a supporting surface 32*a* formed of the bottom surface of a notch provided in the side wall of the channel and the inner surface of a member, preferably an elastic member, bonded to the side wall of the channel.

FIG. 17-G shows a back-up member 30, similar to the back-up member shown in FIG. 16-C, bonded to each of the surfaces of the peripheral edge of glass sheet 2.

FIG. 17-H shows a back-up member 30 having a base portion, substantially U-shaped in cross section, to be fitted over the peripheral edge of glass sheet 2 and two tongue-like portions extending substantially horizontally from the base portion in opposite directions to each other.

FIG. 17-I shows a combination of the supporting surface shown in FIG. 17-C and the supporting surface shown in FIG. 17-H.

In still another embodiment, a back-up member 30 having a tongue-like portion extending approximately at right angles to the side wall of the channel is secured as shown in FIGS. 18-A and 18-B, and a back-up member 30 having a tongue-like portion extending approximately at right angles to the surface of glass sheet 2 is also secured to the peripheral edge of glass sheet 2, whereby the tongue-like portion of one back-up member forms a supporting surface of the tongue-like portion of the other, as shown in FIGS. 18-C and 18-D.

FIG. 18-E shows a combination of the back-up member shown in FIG. 18-A and the back-up member shown in FIG. 18-D. FIG. 18-F shows a combination of the back-up member shown in FIG. 18-A and the back-up member shown in FIG. 18-F.

The present inventors have also found that deformation of glass sheet 2 which may occur at the time of fixing it in sash 4 can be reduced by bonding frame members having higher rigidity than glass sheet 2 and being substantially U-shaped in cross section to nearly all of the peripheral edge of glass sheet 2 before setting glass sheet 2 in sash 4.

Glass sheet 2 fixed in sash 4 by the methods of this invention described hereinabove undergoes far less deformation during the fixing operation than in the conventional methods. However, according to the method described in connection with FIGS. 1 to 11, the inserted elastic spacers 14 directly contact the two surfaces of the peripheral edge of glass sheet 2 although at limited positions spaced at intervals along the peripheral edge of glass sheet 2. Moreover, at positions other than those in which the elastic spacers have been inserted, the back-up members 20 make direct contact with the surfaces of the peripheral edge of glass sheet 2 and exert a local pressing force, although of slight degree, on glass sheet 2. Accordingly, there is a likelihood that deformations will occur in glass sheet 2 although to a slight degree. The present inventors found that when frame members having higher rigidity than glass sheet 2 are bonded by an adhesive to the peripheral edge of glass sheet 2 before setting the glass sheet 2 in sash 4, the slight pressing force is received by the frame members thereby to considerably reduce the local pressing force on glass sheet 2.

The bonding of frame members brings about the secondary advantage that since they cover the sharp edge of glass sheet 2, the glass sheet 2 has increased resistance to various impacts during the setting of glass sheet 2 in sash 4, and the safety of the work is enhanced. Furthermore, in the method described in connection with FIGS. 12 to 18, this frame member can also function as a member for forming a supporting surface which supports the free end of tongue-like portion 30*b* of the back-up member 30.

The method of fixing the frame meember to the peripheral edge of glass sheet 2 by an adhesive will be described below with reference to FIGS. 19 to 22. First, frame members 38 of predetermined sizes to be bonded to the peripheral edges of the four sides of glass sheet 2 are prepared. As illustrated in FIG. 21, the length of each frame member 38 is preferably somewhat shorter than the length of each side of glass sheet 2 to which it is to be bonded, so that when the frame members 38 are bonded to the sides of the glass sheet 2, the four corners of glass sheet 2 will remain exposed. Although it is possible to cover the entire peripheral edge of glass sheet 2 with the frame members 38, the method described above which leaves the four corners of glass sheet 2 exposed is preferred in order, for example, to position glass sheet 2 accurately in sash 4. The inside width *a* of each frame member is preferably 2 mm to 4 mm larger than the thickness of glass sheet 2 so that glass sheet 2 having some warping caused during the manufacturing process will not make direct contact with the inside surface of the frame member 38. The height *b* of the frame member differs according to the thickness and size of the glass sheet, but generally, it is preferably about 1 mm to 2 mm larger than the width *c* (FIG. 22) of the peripheral edge of glass sheet 2 positioned in the frame members 38 which width is preferably 1 to 1.5 times the thickness of the glass sheet.

The material and thickness of each frame member 38 are not particularly restricted so long as it has sufficiently higher rigidity than glass sheet 2. Useful materials are, for example, metals such as stainless steel, aluminum or brass, and various plastics such as hard vinyl chloride resin or polycarbonate. Stainless steel is especially preferred since it has high rigidity even when having a relatively small thickness.

Then, spacers 40 of an elastic material such as natural or synthetic rubber for maintaining the space between each of the surfaces of glass sheet 2 and each of the two facing inner surfaces of frame member 38 constant are preferably adhered to both ends of the two facing inner surfaces or frame member 38. Then, an adhesive 42 is filled in the frame member 38 thereby to bond the frame member 38 to glass sheet 2.

It is important that no load to deform glass sheet 2 should be exerted on it at the time of bonding the frame member 38 to the peripheral edge of glass sheet 2. Hence, the use of a suitable adhesive and a suitable method is important in bonding the frame member 38 to the peripheral edge of glass sheet 2.

The adhesive 42 desirably meets at least one of the following requirements. That is to say, (i) it should not undergo great volumetric expansion in the curing stage; (ii) it should be expanded at the initial stage of curing when it can still flow sufficiently; and (iii) it should have considerable flexibility after complete curing. The last requirement is essential when the frame member 38 is made of a material having a much higher coefficient of thermal expansion than glass sheet 2, because it is helpful for preventing the breakage of glass by heat.

The present inventors found as a result of extensive experiments that a foam liquid urethane resin is most suitable as the adhesive 42 for bonding frame members 38 to glass sheet 2. The foam liquid urethane resin has high flowability even at the initial stage of curing, cures at a high rate, and possesses elasticity even after curing. Thus, even when the frame member 38 is made of metal, the use of this urethane resin adhesive ensures freedom from any likelihood of the breakage of glass due to changes in temperature.

Figure 20:
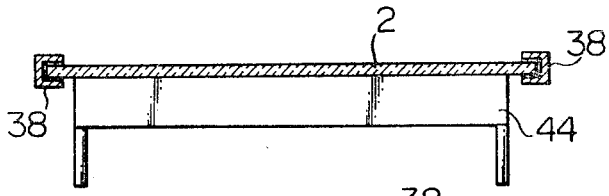
FIG. 20 is a sectional view showing a glass sheet placed on a worktable for bonding a frame member to the peripheral edge of the glass sheet.
Figure 22:
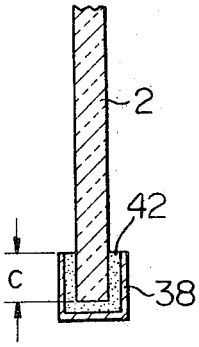
FIG. 22 is a partial, sectional view of the glass sheet shown in FIG. 21.
Figure 21:
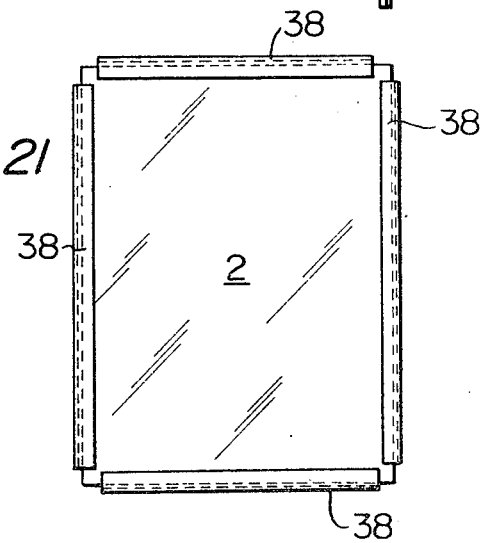
FIG. 21 is a front elevation of a glass sheet having a frame member bonded to its peripheral edge.

In the setting of frame members 38 having the adhesive 42 filled therein on the peripheral edge of glass sheet 2, the glass sheet 2 is desirably placed on a worktable 44 having a high degree of surface flatness, as shown in FIG. 20, in order to maintain it in place and minimize the deformation of its peripheral edge until the adhesive 42 cures. Then the frame members 38 having the adhesive 42 filled therein are fitted to the peripheral edge of glass sheet 2 placed on the worktable 44 and the adhesive 42 is cured, whereby a glass sheet 2 having the frame members 38 fixed at the peripheral edge of its four sides is obtained.

Figure 23:
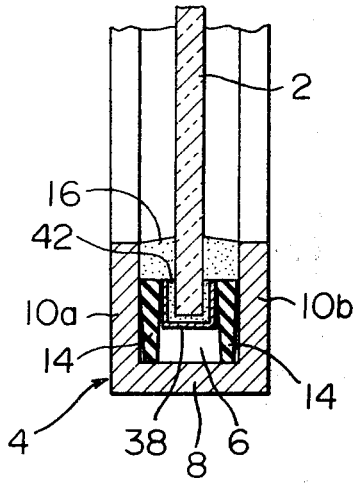
FIG. 23 is a partial, sectional view showing the relationship of pre-fabricated elastic spacers to a frame member bonded to the peripheral edge of a glass sheet.
Figure 24:
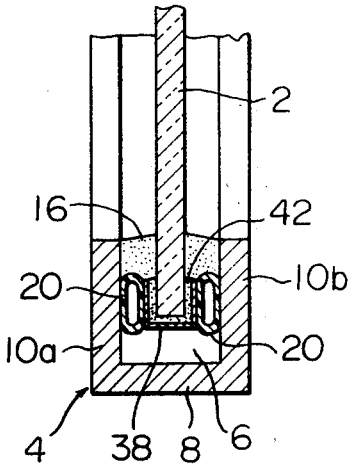
FIG. 24 is a partial, sectional view showing the relationship of back-up members forming back-up surfaces for an elastic sealing material to a frame member bonded to the peripheral edge of a glass sheet.
Figure 25:
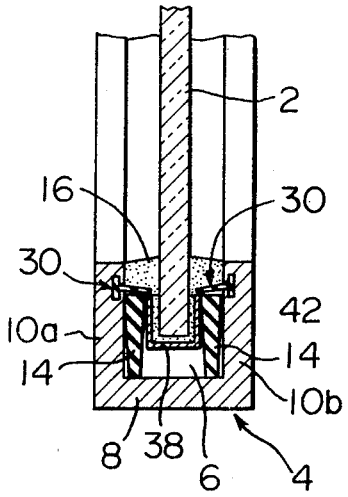
FIG. 25 is a partial, sectional view showing the relationship of tongue-like parts of back-up members secured to the side wall of a sash channel to a frame member bonded to the peripheral edge of a glass sheet.

The glass sheet 2 so obtained is fixed in sash 4 by the method described hereinabove in connection with FIGS. 1 to 18. As can be readily appreciated from FIG. 23, when elastic spacers 14 are inserted between each of the surfaces of the peripheral edge of glass sheet 2 and each of the side walls 10*a* and 10*b* of channel opposite thereto at positions spaced at intervals along the peripheral edge of glass sheet 2, the spacers 14 do not make direct contact with the surface of glass sheet 2, but contact the outside surfaces of the frame members 38. Furthermore, as can be readily appreciated from FIG. 24, when soft back-up members 20 are disposed between each of the surfaces of the peripheral edge of glass sheet 2 and each of the side walls 10*a* and 10*b* of channel 6, these back-up members 20, do not make direct contact with the surface of glass sheet 2, but contact the outside surfaces of the frame members 38. Again, as described hereinabove in connection with FIGS. 12 to 15, when elastic back-up members are used which include a base portion 30*a* to be fitted to each of the side walls 10*a* and 10*b* of channel 6 of sash 4 and a tongue-like portion 30*b* extending approximately at right angles to the side walls 10*a* and 10*b*, the inner surfaces of the frame members 38 and the inner surfaces of the layer of adhesive 42 function as supporting surfaces which will support the free ends of tongue-like portions 30*b* of back-up members 30, as can be readily appreciated from FIG. 25.

While the present invention has been described hereinabove with reference to some preferred embodiments taken in conjunction with the accompanying drawings, it should be understood that the invention is not limited to these specific embodiments, but various changes and modifications are possible without departing from the scope of the invention.

What we claim is:

1. An assembly comprising a glass sheet and a sash surrounding the entire peripheral edge of the glass sheet, said sash having a channel defined by a bottom wall and side walls;

(a) means in said channel supporting the entire peripheral edge of the glass sheet in the channel and spaced from the bottom wall of the channel, (b) a plurality of spaced elastic spacers being positioned in the space between each of the face surfaces of the glass sheet adjacent the peripheral edge of the glass sheet and each of the side walls of the channel opposite thereto at intervals along the periphery of the glass sheet, thereby to fix the glass sheet in the sash at said spaced intervals while exerting only minimum distorting forces on said glass sheet;

(c) a seal along the entire peripheral edge of the glass sheet of an initially softened or liquid and subsequently hardened elastic sealing material in the space between each of the surfaces adjacent the peripheral edge of the glass sheet and each of the surfaces of the side walls of the channel opposite thereto and spaced from the bottom of the channel to leave a space at the bottom of the channel, said seal being substantially fluid-tight and covering the entire periphery of the glass sheet, thus sealing the glass sheet in the sash; and (d) back-up means positioned between adjacent elastic spacers in the space between each of the surfaces adjacent the peripheral edge of the glass sheet and each of the side walls of the channel opposite thereto and spaced from the bottom of the channel and in pressure-free engagement with the surfaces of the glass for forming a back-up surface for the elastic sealing material.

2. The assembly of claim 1 further comprising back-up members having an elastic tongue-like part with a free end fixed to one of the opposite surfaces defining the space between each surface of the glass sheet adjacent the peripheral edge of the glass sheet and each side wall of the channel, said elastic tongue-like part extending from one of the opposite surfaces toward the other with the free end of said tongue-like part being spaced from the other of said opposite surfaces, and at least one supporting means on the other of said opposite surfaces and facing inwardly of said sash and having a surface supporting the free end of the tongue-like part, both the tongue-like parts and the supporting surfaces backing up the filled elastic sealing material.

3. The assembly of claim 2 wherein said back-up members are fixed to the surfaces of each of the side walls of the channel, and said glass has a substantially U-shaped cross section member of an elastic material fitted over the peripheral edge of the glass sheet with the ends of the legs thereof facing inwardly of the sash being said supporting surfaces.

4. The assembly of claim 2 wherein said supporting surfaces are nearer to the bottom wall of said channel than said tongue-like parts.

5. The assembly of claim 2 wherein each of said back-up members has a base portion secured to one of said opposite surfaces and the tongue-like part extends towards the other of said opposite surfaces at approximately right angles to said one opposite surface.

6. The assembly of claim 5 wherein said back-up members are fixed to the surfaces of each of the side walls of the channel, and said glass has a substantially U-shaped cross section member of an elastic material fitted over the peripheral edge of the glass sheet with the ends of the legs thereof facing inwardly of the sash being said supporting surfaces.

7. The assembly of claim 1 further comprising substantially U-shaped cross section frame members of a material having greater rigidity than the glass sheet resiliently adhesively bonded to substantially all of the peripheral edge of the glass sheet.

8. The assembly of claim 7 wherein said frame members are made of stainless steel, and said adhesive is a foam liquid urethane resin.

9. The assembly as claimed in claim 1 in which said back-up members are made of a flexible material.

10. An assembly comprising a glass sheet and a sash surrounding the entire peripheral edge of the glass sheet, said sash having a channel defined by a bottom wall and side walls;

(a) means in said channel supporting the entire peripheral edge of the glass sheet in the channel spaced from the bottom wall and side walls of the channel, (b) back-up members having an elastic tongue-like part with a free end fixed to one of the opposite surfaces defining the spaces between each surface of the glass sheet adjacent the peripheral edge of the glass sheet and each side wall of the channel, said elastic tongue-like part extending from one of the opposite surfaces toward the other with the free end of said tongue-like part being spaced from the other of said opposite surfaces, and at least one supporting means on the other of said opposite surfaces and facing inwardly of said sash and having a surface supporting the free end of the tongue-like part, and (c) a seal along the entire peripheral edge of the glass sheet of an initially softened or liquid and subsequently hardened elastic sealing material over the tongue-like parts of the back-up members in the space between each of the surfaces adjacent the peripheral edge of the glass sheet and each of the side walls of the channel opposite thereto, the tongue-like parts and supporting surfaces being spaced from the bottom of the channel to leave a space at the bottom of the channel, the space between each of the surfaces of the peripheral edge of the glass sheet and each of the side walls of the channel along the entire peripheral edge of the glass sheet being sealed by said sealing material and said sealing material fixing the glass sheet in the sash.

11. The assembly of claim 10 wherein said back-up members are fixed to the surfaces of each of the side walls of the channel, and said glass has a substantially U-shaped cross section member of an elastic material fitted over the peripheral edge of the glass sheet with the ends of the legs thereof facing inwardly of the sash being said supporting surfaces.

12. The assembly of claim 10 wherein each of said back-up members has a base portion secured to one of said opposite surfaces and the tongue-like part extends from the base portion toward the other of said opposite surfaces at approximately right angles to said one opposite surface.

13. The assembly of claim 12 wherein said back-up members are fixed to the surfaces of each of the side walls of the channel, and said glass has a substantially U-shaped cross section member of an elastic material fitted over the peripheral edge of the glass sheet with the ends of the legs thereof facing inwardly of the sash being said supporting surfaces.

14. The assembly of claim 10 further comprising substantially U-shaped cross section frame members of a material having greater rigidity than the glass sheet resiliently adhesively bonded to substantially all of the peripheral edge of the glass sheet.

15. The assembly of claim 14 wherein said back-up members are fixed to the surfaces of each of the side walls of the channel, and said supporting surfaces are constituted by the ends of the legs of the frame members and the surface of the layer of the adhesive within the frame members which faces inwardly of said sash.

16. The assembly of claim 14 wherein said frame members are made of stainless steel, and said adhesive is a foam liquid urethane resin.

17. The assembly of claim 16 wherein said back-up members are fixed to the surfaces of each of the side walls of the channel, and said supporting surfaces are constituted by the ends of the legs of the frame members and the surface of the layer of the adhesive within the frame members which faces inwardly of said sash.

* * * * *

UNITED STATES PATENT AND TRADEMARK OFFICE

CERTIFICATE OF CORRECTION

PATENT NO. : 4,139,973

DATED : February 20, 1979

INVENTOR(S) : RYUZO FUJITA and HIROKAZU SUGIYAMA

It is certified that error appears in the above-identified patent and that said Letters Patent are hereby corrected as shown below:

In the heading, line 73, change "Nippon Sheet Glass Co., Inc." to --Nippon Sheet Glass Co., Ltd.--.

Signed and Sealed this

*Nineteenth* Day of *June 1979*

[SEAL]

*Attest:*

RUTH C. MASON
*Attesting Officer*

DONALD W. BANNER
*Commissioner of Patents and Trademarks*